US010369574B2

(12) United States Patent
Cook et al.

(10) Patent No.: US 10,369,574 B2
(45) Date of Patent: Aug. 6, 2019

(54) LOOSEFILL INSULATION BLOWING MACHINE HOSE OUTLET PLATE ASSEMBLY

(71) Applicant: Owens Corning Intellectual Capital, LLC, Toledo, OH (US)

(72) Inventors: David M. Cook, Granville, OH (US); Todd Jenkins, Newark, OH (US); Ryan S. Crisp, Lewis Center, OH (US); Shannon D. Staats, Ostrander, OH (US); Christopher M. Relyea, Columbus, OH (US)

(73) Assignee: Owens Corning Intellectual Property Capital, LLC, Toledo, OH (US)

( * ) Notice: Subject to any disclaimer, the term of this patent is extended or adjusted under 35 U.S.C. 154(b) by 633 days.

(21) Appl. No.: 15/095,695

(22) Filed: Apr. 11, 2016

(65) Prior Publication Data

US 2016/0303576 A1 Oct. 20, 2016

Related U.S. Application Data

(60) Provisional application No. 62/147,146, filed on Apr. 14, 2015.

(51) Int. Cl.

| | |
|---|---|
| ***B02C 18/00*** | (2006.01) |
| ***B02C 18/22*** | (2006.01) |
| ***E04F 21/08*** | (2006.01) |

(52) U.S. Cl.

CPC ..... *B02C 18/2216* (2013.01); *B02C 18/2225* (2013.01); *B02C 18/2291* (2013.01); *E04F 21/085* (2013.01)

(58) Field of Classification Search

CPC ..... B02C 18/2216; B02C 18/2225; B02C 18/2291; E04F 21/085

USPC ..... 241/605, 60

See application file for complete search history.

(56) References Cited

U.S. PATENT DOCUMENTS

| | | | |
|---|---|---|---|
| 1,811,898 | A | 6/1931 | Schur et al. |
| 2,049,063 | A | 7/1936 | Hubbard |
| 2,193,849 | A | 3/1940 | Whitfield |
| 2,262,094 | A | 11/1941 | Burt |
| 2,291,871 | A | 8/1942 | Bokum et al. |
| 2,311,773 | A | 2/1943 | Patterson |

(Continued)

FOREIGN PATENT DOCUMENTS

| | | | |
|---|---|---|---|
| GB | 2124194 | A | 2/1984 |

*Primary Examiner* — Faye Francis

(74) *Attorney, Agent, or Firm* — MacMillan, Sobanski & Todd, LLC

(57) ABSTRACT

A machine for distributing blowing insulation material from a package of compressed loosefill insulation material is provided. The machine includes a chute having an inlet portion and outlet portion. The inlet portion is configured to receive the package of compressed loosefill insulation material. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The discharge mechanism includes a hose outlet plate assembly configured to cover an outlet end of the discharge mechanism and is further configured to connect a distribution hose to the discharge mechanism. The hose outlet plate assembly includes a tapered passage extending from the outlet end of the discharge mechanism to the distribution hose.

20 Claims, 8 Drawing Sheets

(56) References Cited

U.S. PATENT DOCUMENTS

| | | | |
|---|---|---|---|
| 2,355,358 | A | 8/1944 | Anderson |
| 2,437,831 | A | 3/1948 | Moore |
| 2,532,318 | A | 12/1950 | Mackey et al. |
| 2,532,351 | A | 12/1950 | Wedebrock |
| 2,550,354 | A | 4/1951 | Jacobsen |
| 2,721,767 | A | 10/1955 | Kropp |
| 2,938,651 | A | 5/1960 | Specht et al. |
| 2,989,252 | A | 6/1961 | Babb |
| 3,051,398 | A | 8/1962 | Babb |
| 3,175,866 | A | 3/1965 | Nichol |
| 3,861,599 | A | 1/1975 | Waggoner |
| 4,179,043 | A | 12/1979 | Fischer |
| 4,236,654 | A | 12/1980 | Mello |
| 4,273,296 | A | 6/1981 | Hoshall |
| 4,337,902 | A | 7/1982 | Markham |
| 4,344,580 | A | 8/1982 | Hoshall et al. |
| 4,365,762 | A | 12/1982 | Hoshall |
| 4,411,390 | A | 10/1983 | Woten |
| 4,560,307 | A | 12/1985 | Deitesfeld |
| 4,978,252 | A | 12/1990 | Sperber |
| 5,014,885 | A | 5/1991 | Heep et al. |
| 5,392,964 | A | 2/1995 | Stapp et al. |
| 5,462,238 | A | 10/1995 | Smith et al. |
| 5,511,730 | A | 4/1996 | Miller et al. |
| 5,620,116 | A | 4/1997 | Kluger et al. |
| 5,639,033 | A | 6/1997 | Miller et al. |
| 5,647,696 | A | 7/1997 | Sperber |
| 5,829,649 | A | 11/1998 | Horton |
| 5,927,558 | A | 7/1999 | Bruce |
| 6,036,060 | A | 3/2000 | Munsch et al. |
| 6,503,026 | B1 | 1/2003 | Mitchell |
| 6,796,748 | B1 | 9/2004 | Sperber |
| 7,845,585 | B2 | 12/2010 | Evans et al. |
| 8,056,843 | B2 | 11/2011 | Evans et al. |
| 2004/0124262 | A1 | 7/2004 | Bowman et al. |

LOOSEFILL INSULATION BLOWING MACHINE HOSE OUTLET PLATE ASSEMBLY

RELATED APPLICATIONS

This application claims priority from U.S. Provisional Patent Application No. 62/147,146 filed Apr. 14, 2015, the disclosure of which is incorporated herein by reference in its entirety.

BACKGROUND

When insulating buildings and installations, a frequently used insulation product is loosefill insulation material. In contrast to the unitary or monolithic structure of insulation materials formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that can condition the loosefill insulation material to a desired density and feed the conditioned loosefill insulation material pneumatically through a distribution hose. Blowing insulation machines typically have a funnel-shaped chute or hopper for containing and feeding the blowing insulation material after the package is opened and the blowing insulation material is allowed to expand.

It would be advantageous if insulation blowing machines could be improved to make them more efficient.

SUMMARY

The above objects as well as other objects not specifically enumerated are achieved by a machine for distributing blowing insulation material from a package of compressed loosefill insulation material. The machine includes a chute having an inlet portion and outlet portion. The inlet portion is configured to receive the package of compressed loosefill insulation material. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The discharge mechanism includes a hose outlet plate assembly configured to cover an outlet end of the discharge mechanism and is further configured to connect a distribution hose to the discharge mechanism. The hose outlet plate assembly includes a tapered passage extending from the outlet end of the discharge mechanism to the distribution hose.

There is also provided a machine for distributing blowing insulation material from a package of compressed loosefill insulation material. The machine includes a chute having an inlet portion and outlet portion. The inlet portion is configured to receive the package of compressed loosefill insulation material. A lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The discharge mechanism includes a hose outlet plate assembly configured to cover an outlet end of the discharge mechanism and further configured to connect a distribution hose to the discharge mechanism. The hose outlet plate assembly includes an internal passage defined at one end by a transitional wall having a non-circular perimeter.

There is also provided a machine for distributing blowing insulation material from a package of compressed loosefill insulation material. The machine includes a chute having an inlet portion and outlet portion. The inlet portion is configured to receive the package of compressed loosefill insulation material a lower unit is configured to receive the compressed loosefill insulation material exiting the outlet portion of the chute. The lower unit includes a plurality of shredders and a discharge mechanism. The discharge mechanism is configured to discharge conditioned loosefill insulation material into an airstream. The discharge mechanism includes a hose outlet plate assembly configured to cover an outlet end of the discharge mechanism and further configured to connect a distribution hose to the discharge mechanism. The hose outlet plate assembly includes an internal passage defined by a transitional wall. The transitional wall has an inner perimeter with a length that is longer than a length of an outer perimeter.

There is also provided a machine for distributing blowing insulation material from a package of compressed loosefill insulation material. The machine includes a chute having an inlet portion and outlet portion. The inlet portion is configured to receive the package of compressed loosefill insulation material. A lower unit is configured to receive the compressed loosefill insulation material exiting the outlet portion of the chute. The lower unit includes a plurality of shredders and a discharge mechanism. The discharge mechanism includes rotatable spaced apart sealing vane assemblies configured to discharge conditioned loosefill insulation material into an airstream. The discharge mechanism includes a hose outlet plate assembly configured to cover an outlet end of the discharge mechanism and further configured to connect a distribution hose to the discharge mechanism. The hose outlet plate assembly includes an internal passage defined at one end by a transitional wall having a perimeter. The perimeter substantially occupies a wedge-shaped space between adjacent sealing vane assemblies.

Various objects and advantages of the loosefill insulation blowing machine hose outlet plate assembly will become apparent to those skilled in the art from the following detailed description, when read in light of the accompanying drawings.

DETAILED DESCRIPTION OF THE INVENTION

Figure 1:
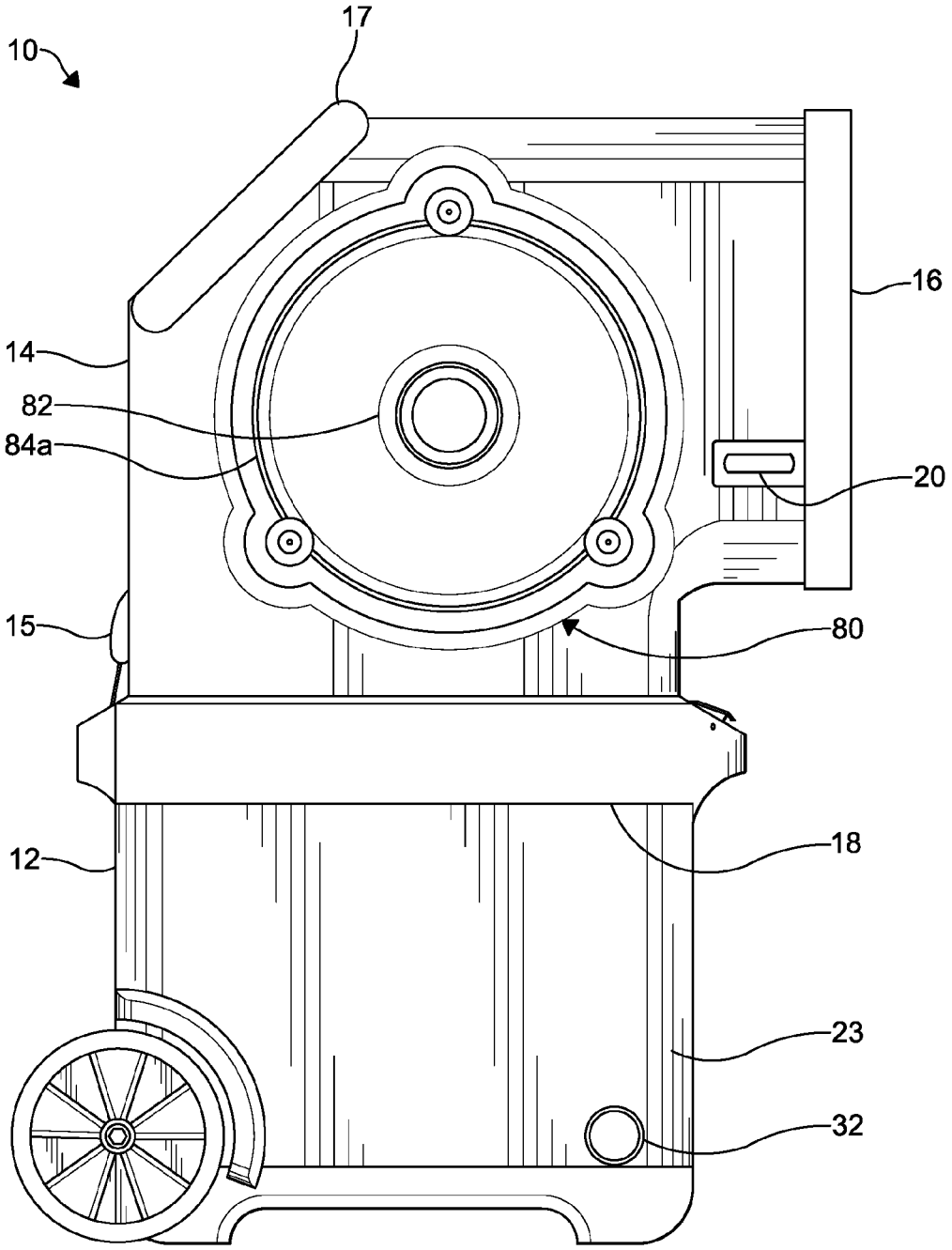
FIG. 1 is a front view, in elevation, of a loosefill insulation blowing machine.

The loosefill insulation blowing machine hose outlet plate assembly will now be described with occasional reference to specific embodiments. The loosefill insulation blowing machine hose outlet plate assembly may, however, be embodied in different forms and should not be construed as limited to the embodiments set forth herein. Rather, these embodiments are provided so that this disclosure will be thorough and complete, and will fully convey the scope of the loosefill insulation blowing machine hose outlet plate assembly to those skilled in the art.

Unless otherwise defined, all technical and scientific terms used herein have the same meaning as commonly understood by one of ordinary skill in the art to which the loosefill insulation blowing machine hose outlet plate assembly belongs. The terminology used in the description of the loosefill insulation blowing machine hose outlet plate assembly herein is for describing particular embodiments only and is not intended to be limiting of the loosefill insulation blowing machine hose outlet plate assembly. As used in the description of the loosefill insulation blowing machine hose outlet plate assembly and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the loosefill insulation blowing machine hose outlet plate assembly. Notwithstanding that the numerical ranges and parameters setting forth the broad scope of the loosefill insulation blowing machine hose outlet plate assembly are approximations, the numerical values set forth in the specific examples are reported as precisely as possible. Any numerical values, however, inherently contain certain errors necessarily resulting from error found in their respective measurements.

The description and figures disclose a loosefill insulation blowing machine hose outlet plate assembly. The hose outlet plate assembly provides a tapered passage for an airstream entrained with finely conditioned loosefill insulation material exiting a discharge mechanism and flowing to a distribution hose. The tapered passage provides a balance between the ability of the blowing machine to provide a high throughput of conditioned loosefill insulation material through the distribution hose 38 with the ability to substantially prevent unwanted accumulations of conditioned loosefill insulation material in the discharge mechanism 28 and the distribution hose 38.

The term "loosefill insulation material", as used herein, is defined to mean any insulating material configured for distribution in an airstream. The term "finely conditioned", as used herein, is defined to mean the shredding, picking apart and conditioning of loosefill insulation material to a desired density prior to distribution into an airstream.

Figure 2:
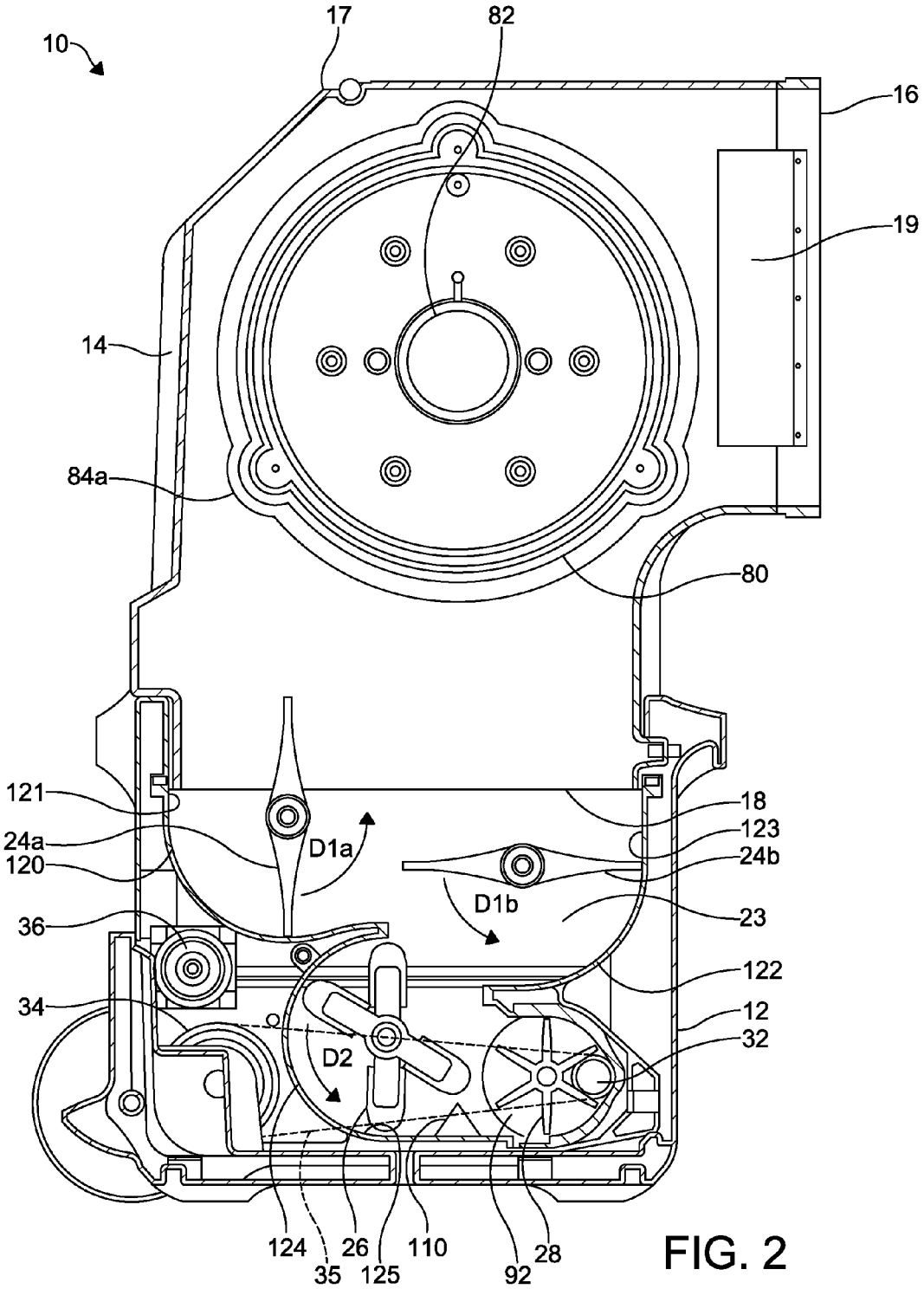
FIG. 2 is a front view, in elevation, partially in cross-section, of the loosefill insulation blowing machine of FIG. 1.
Figure 3:
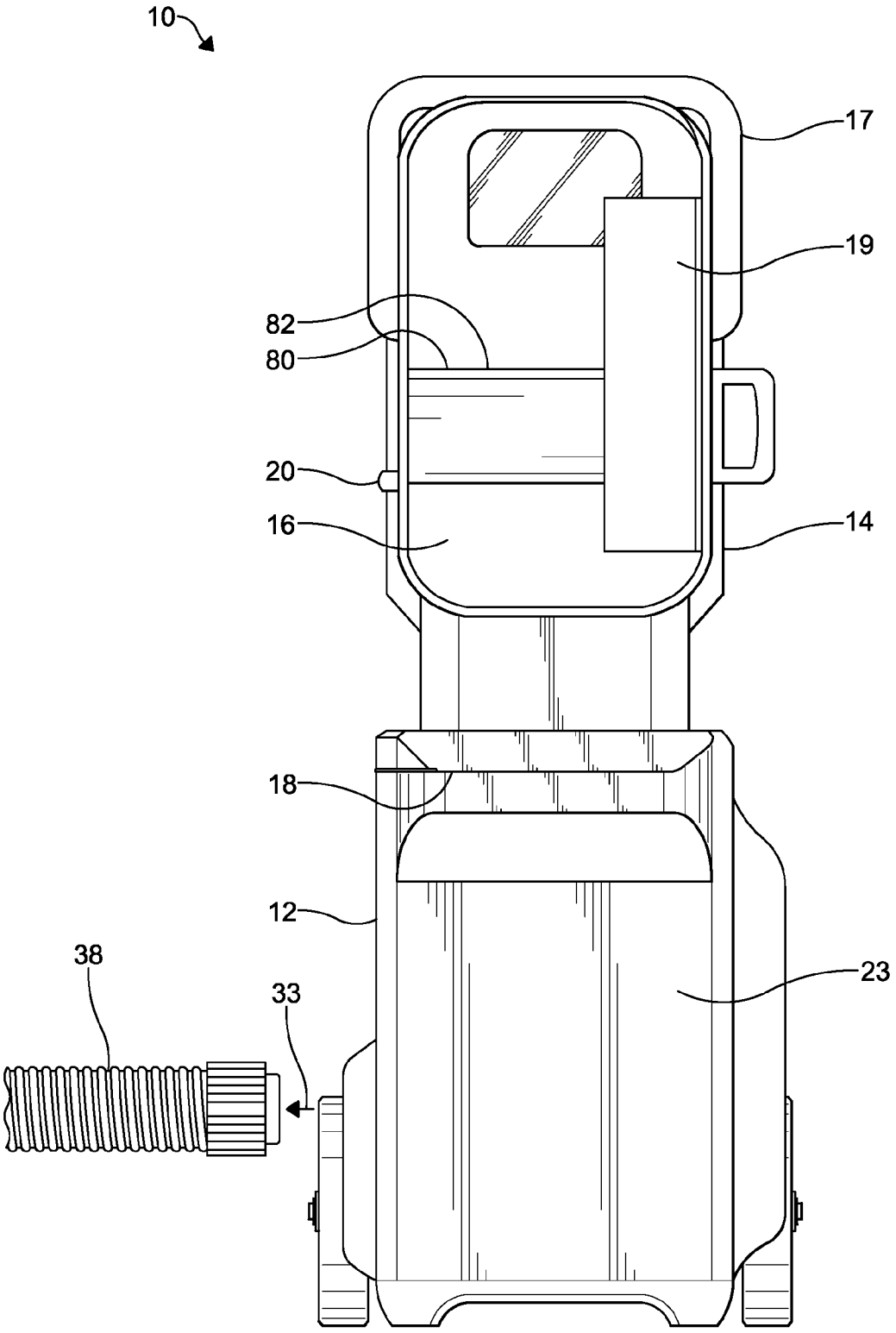
FIG. 3 is a side view, in elevation, of the loosefill insulation blowing machine of FIG. 1.

Referring now to FIGS. 1-3, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms 15, configured to readily assemble and disassemble the chute 14 to the lower unit 12. The chute 14 has an inlet portion 16 and an outlet portion 18.

Referring again to FIGS. 1-3, the inlet portion 16 of the chute 14 is configured to receive compressed loosefill insulation material typically contained within a package (not shown). As the package of compressed loosefill insulation material is guided into an interior of the chute 14, the cross-sectional shape and size of the chute 14 relative to the cross-sectional shape and size of the package of compressed loosefill insulation material directs an expansion of the compressed loosefill insulation material to a direction toward the outlet portion 18, wherein the loosefill insulation material is introduced to a shredding chamber 23 positioned in the lower unit 12.

Referring again to FIGS. 1-3, optionally the chute 14 can include one or more handle segments 17, configured to facilitate ready movement of the blowing machine 10 from one location to another. The handle segment 17 can have any desired structure and configuration. However, it should be understood that the one or more handle segments 17 are not necessary to the operation of the blowing machine 10.

Referring again to FIGS. 1-3, the chute 14 includes a bail guide 19, mounted at the inlet portion 16 of the chute 14. The bail guide 19 is configured to urge a package of compressed loosefill insulation material against a cutting mechanism 20 as the package of compressed loosefill insulation material moves further into the interior of the chute 14. The bail guide 19 and the cutting mechanism 20 can have any desired structure.

Referring again to FIGS. 1-3, the chute 14 includes a distribution hose storage structure 80. The distribution hose storage structure 80 is configured to store a distribution hose 38 within the chute 14 in the event the blowing machine 10 is not in use. The distribution hose storage structure 80 includes a hose hub 82 attached to flanges 84*a*, 84*b*, with each of the flanges 84*a*, 84*b* being mounted in opposing sides of the chute 14.

Referring now to FIG. 2, the shredding chamber 23 is mounted in the lower unit 12, downstream from the outlet portion 18 of the chute 14. The shredding chamber 23 can include a plurality of low speed shredders 24*a*, 24*b* and one or more agitators 26. The low speed shredders 24*a*, 24*b* are configured to shred, pick apart and condition the loosefill insulation material as the loosefill insulation material is discharged into the shredding chamber 23 from the outlet portion 18 of the chute 14. The one or more agitators 26 are configured to finely condition the loosefill insulation material to a desired density as the loosefill insulation material exits the low speed shredders 24*a*, 24*b*. It should be appreciated that any quantity of low speed shredders and agitators can be used. Further, although the blowing machine 10 is described with low speed shredders and agitators, any type or combination of separators, such as clump breakers, beater bars or any other mechanisms, devices or structures that shred, pick apart, condition and/or finely condition the loosefill insulation material can be used.

Referring again to the embodiment shown in FIG. 2, the agitator 26 is positioned vertically below the low speed shredders 24*a*, 24*b*. Alternatively, the agitator 26 can be positioned in any location relative to the low speed shredders 24*a*, 24*b*, such as horizontally adjacent to the low speed shredders 24*a*, 24*b*, sufficient to finely condition the loosefill insulation material to a desired density as the loosefill insulation material exits the low speed shredders 24*a*, 24*b*.

In the embodiment illustrated in FIG. 2, the low speed shredders 24*a*, 24*b* rotate in a counter-clockwise direction, as shown by direction arrows D1*a*, D1*b* and the one or more agitators 26 also rotate in a counter-clockwise direction, as shown by direction arrow D2. Rotating the low speed shredders 24*a*, 24*b* and the agitator 26 in the same counter-clockwise directions, D1*a*, D1*b* and D2, allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, the low speed shredders 24*a*, 24*b* and the agitator 26 could rotate in a clock-wise direction or the low speed shredders 24*a*, 24*b* and the agitator 26 could rotate in different directions provided an accumulation of unshredded or partially shredded loosefill insulation material does not occur in the shredding chamber 23.

Referring again to the embodiment shown in FIG. 2, the low speed shredders 24*a*, 24*b* rotate at a lower rotational speed than the agitator 26. The low speed shredders 24*a*, 24*b* rotate at a speed of about 40-80 revolutions per minute (rpm) and the agitator 26 rotates at a speed of about 300-500 rpm. In another embodiment, the low speed shredders 24*a*, 24*b* can rotate at a speed less than about 40-80 rpm, provided the speed is sufficient to shred and pick apart the loosefill insulation material. In still other embodiments, the agitator 26 can rotate at a speed less than or more than 300-500 rpm provided the speed is sufficient to finely shred the loosefill insulation material and prepare the loosefill insulation material for distribution into an airstream.

Referring again to FIG. 2, the shredding chamber 23 includes a first guide shell 120 positioned partially around the low speed shredder 24*a*. The first guide shell 120 extends to form an arc of approximately 90°. The first guide shell 120 has an inner surface 121. The first guide shell 120 is configured to allow the low speed shredder 24*a* to seal against the inner surface 121 and thereby direct the loosefill insulation material in a downstream direction as the low speed shredder 24*a* rotates.

Referring again to FIG. 2, the shredding chamber 23 includes a second guide shell 122 positioned partially around the low speed shredder 24*b*. The second guide shell 122 extends to form an arc of approximately 90°. The second guide shell 122 has an inner surface 123. The second guide shell 122 is configured to allow the low speed shredder 24*b* to seal against the inner surface 123 and thereby direct the loosefill insulation material in a downstream direction as the low speed shredder 24*b* rotates.

Referring again to FIG. 2, the shredding chamber 23 includes a third guide shell 124 positioned partially around the agitator 26. The third guide shell 124 extends to form an approximate semi-circle. The third guide shell 124 has an inner surface 125. The third guide shell 124 is configured to allow the agitator 26 to seal against the inner surface 125 and thereby direct the finely conditioned loosefill insulation material in a downstream direction as the agitator 26 rotates.

In the embodiment shown in FIG. 2, the inner surfaces 121, 123 and 125, are formed from a high density polyethylene material (hdpe) configured to provide a lightweight, low friction sealing surface and guide for the loosefill insulation material. Alternatively, the inner surfaces 121, 123 and 125 can be formed from other materials, such as aluminum, sufficient to provide a lightweight, low friction sealing surface and guide that allows the low speed shredders 24*a*, 24*b* and the agitator 26 to direct the loosefill insulation material downstream.

Referring again to FIG. 2, a discharge mechanism, shown schematically at 28, is positioned downstream from the one or more agitators 26 and is configured to distribute the finely conditioned loosefill insulation material exiting the agitator 26 into an airstream, shown schematically by arrow 33 in FIG. 3. In the illustrated embodiment, the discharge mechanism 28 is a rotary valve. In other embodiments, the discharge mechanism 28 can be other structures, mechanisms and devices, such as for example staging hoppers, metering devices or rotary feeders, sufficient to distribute the finely conditioned loosefill insulation material into the airstream 33.

Referring again to FIG. 2, the finely conditioned loosefill insulation material is driven through the discharge mechanism 28 and through a machine outlet 32 by the airstream 33. The airstream 33 is provided by a blower 34 and associated ductwork, shown in phantom at 35. In alternate embodiments, the airstream 33 can be provided by other structures and manners, such as by a vacuum, sufficient to provide the airstream 33 through the discharge mechanism 28.

Referring again to FIG. 2, the low speed shredders 24*a*, 24*b*, agitator 26 and discharge mechanism 28 are mounted for rotation. In the illustrated embodiment, they are driven by an electric motor 36 and associated drive means (not shown). However, in other embodiments, the low speed shredders 24*a*, 24*b*, agitator 26 and discharge mechanism 28 can be driven by any suitable means. In still other embodiments, each of the low speed shredders 24*a*, 24*b*, agitator 26 and discharge mechanism 28 can be provided with its own source of rotation. In the illustrated embodiment, the electric motor 36 driving the low speed shredders 24*a*, 24*b*, agitator 26 and discharge mechanism 28 is configured to operate on a single 15 ampere, 110 volt a.c. electrical power supply. In other embodiments, other suitable power supplies can be used.

Referring again to FIG. 2, the discharge mechanism 28 is configured with a side inlet 92. The side inlet 92 is configured to receive the finely conditioned loosefill insulation material as it is fed in a substantially horizontal direction from the agitator 26. In this embodiment, the side inlet 92 of the discharge mechanism 28 is positioned to be horizontally adjacent to the agitator 26. In another embodiment, a low speed shredder 24*a* or 24*b*, or a plurality of low speed shredders 24*a*, 24*b* or agitators 26, or other shredding mechanisms can be horizontally adjacent to the side inlet 92 of the discharge mechanism 28 or in other suitable positions.

Referring again to FIG. 2, a choke 110 is positioned between the agitator 26 and the discharge mechanism 28. In this position, the choke 110 is configured to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning. In the illustrated embodiment, the choke 110 has a substantially triangular cross-sectional shape. However, the choke 110 can have other cross-sectional shapes sufficient to allow finely conditioned loosefill insulation material to enter the side inlet 92 of the discharge mechanism 28 and redirect heavier clumps of conditioned loosefill insulation material past the side inlet 92 of the discharge mechanism 28 and back to the low speed shredders, 24*a* and 24*b*, for further conditioning.

Referring again to FIG. 2, in operation, the inlet portion 16 of the chute 14 receives a package of compressed loosefill insulation material. As the package of compressed loosefill insulation material moves into the chute 14, the bale guide 19 urges the package against the cutting mechanism 20 thereby cutting an outer protective covering and allowing the compressed loosefill insulation within the package to expand. As the compressed loosefill insulation material expands within the chute 14, the chute 14 directs the expanding loosefill insulation material past the outlet portion 18 of the chute 14 and into the shredding chamber 23. The low speed shredders 24*a*, 24*b* receive the loosefill insulation material and shred, pick apart and condition the loosefill insulation material. The loosefill insulation material is directed by the low speed shredders 24*a*, 24*b* to the agitator 26. The agitator 26 is configured to finely condition the loosefill insulation material and prepare the loosefill insulation material for distribution into the airstream 33 by further shredding and conditioning the loosefill insulation material. The finely conditioned loosefill insulation material exits the agitator 26 and enters the discharge mechanism 28 for distribution into the airstream 33 provided by the blower 34. The airstream 33, entrained with the finely conditioned loosefill insulation material, exits the insulation blowing machine 10 at the machine outlet 32 and flows through the distribution hose 38 toward an insulation cavity (not shown).

Figure 4:
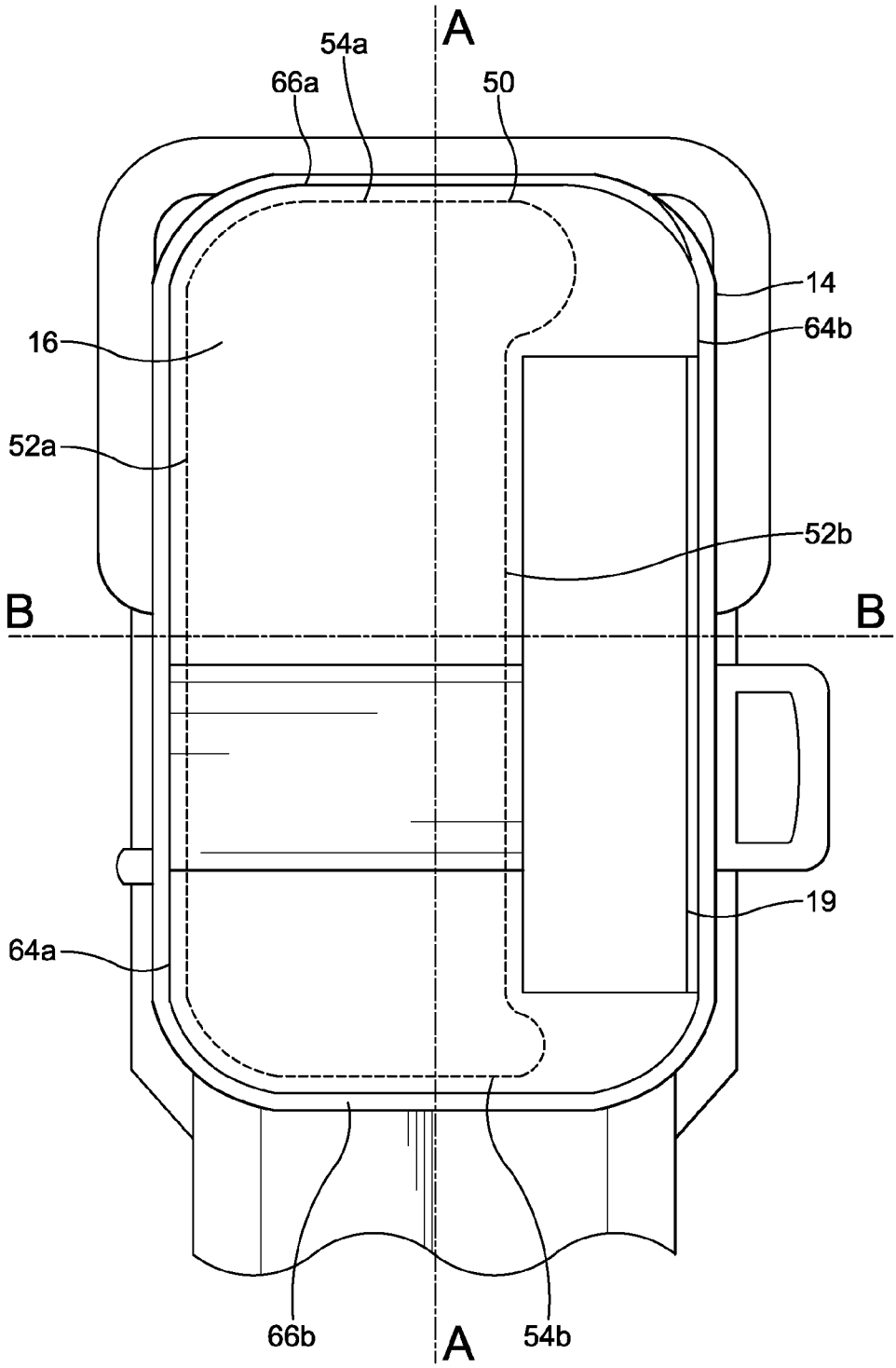
FIG. 4 is a side view, in elevation, of a portion of a chute of the loosefill insulation blowing machine of FIG. 1.

Referring now to FIG. 4, the inlet portion 16 of the chute 14 includes longitudinal sides 64*a*, 64*b* and lateral sides 66*a*, 66*b*. The longitudinal sides 64*a*, 64*b* of the inlet portion 16 of the chute 14, are configured to be substantially vertical and centered about major longitudinal axis A-A. The lateral sides 66*a*, 66*b* are configured to be substantially horizontal and centered about major lateral axis B-B. In operation, a package of compressed loosefill insulation material 50 is fed into the inlet portion 16 of the chute 14 in a manner such that the package has a substantially vertical orientation. The term "vertical orientation", as used herein, is defined to mean major face 52*a* of the package 50 is adjacent to the longitudinal side 64*a*, opposing major face 52*b* is adjacent to the substantially vertical-oriented bale guide 19, and opposing minor faces 54*a*, 54*b* of the package 50 are adjacent to the lateral sides 66*a*, 66*b*. Alternatively, the chute 14 can be configured such that the package 50 has a substantially horizontal orientation when fed into the inlet end 16 of the chute 14.

Figure 5:
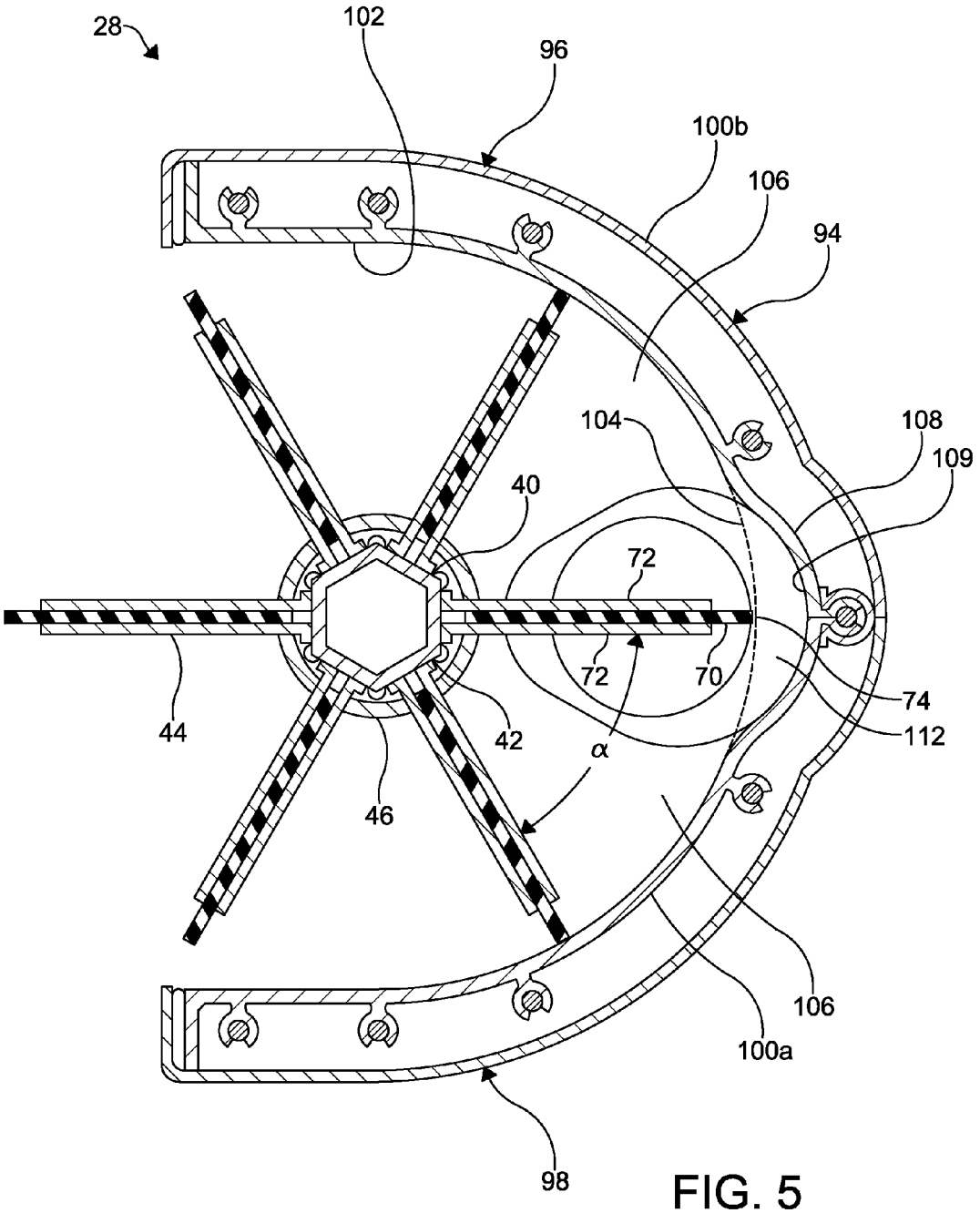
FIG. 5 is a front view, in elevation, in cross-section, of a discharge mechanism of the loosefill insulation blowing machine of FIG. 1.

Referring now to FIG. 5 and as previously discussed, the discharge mechanism 28 is configured to distribute the finely shredded blowing wool into the airstream. The discharge mechanism 28 includes a valve shaft 40 mounted for rotation. In the illustrated embodiment, the valve shaft 40 is a hollow rod having a hexagonal cross-sectional shape. The valve shaft 40 is configured with flat hexagonal surfaces 42 which are used to seat a plurality of sealing vane assemblies 44. Alternatively, other cross-sectional shapes, such as a pentagonal cross-sectional shape, can be used.

In the illustrated embodiment, the valve shaft 40 is made of steel, although the valve shaft 40 can be made of other materials, such as aluminum or plastic, or other materials, sufficient to allow the valve shaft 40 to rotate with the seated sealing vane assemblies 44.

Referring again to FIG. 5, the plurality of sealing vane assemblies 44 are positioned against the flat hexagonal surface 42 of the valve shaft 40 and held in place by a shaft lock 46. The sealing vane assemblies 44 include a sealing core 70 disposed between two opposing vane supports 72. The sealing core 70 includes a vane tip 74 positioned at the outward end of the sealing core 70. The sealing vane assembly 44 is configured such that the vane tip 74 seals against a valve housing 94 as the sealing vane assembly 44 rotates within the valve housing 94. In this embodiment, the sealing core 70 is made from fiber-reinforced rubber. In other embodiments, the sealing core 70 can be made of other materials, such as polymer, silicone, felt, or other materials sufficient to seal against the valve housing 94. In the illustrated embodiment, the fiber-reinforced sealing core 70 has a hardness rating of about 50 A to 70 A as measured by a Durometer. The hardness rating of about 50 A to 70 A allows the sealing core 70 to efficiently seal against the valve housing 94 as the sealing vane assembly 44 rotates within the valve housing 94.

Referring again to FIG. 5, the sealing vane assemblies 44, attached to the valve shaft 40 by the shaft lock 46, rotate within the valve housing 94. In the illustrated embodiment, the valve housing 94 is made from an aluminum extrusion, although the valve housing 94 can be made from other materials, including brass or plastic, sufficient to form a housing within which sealing vane assemblies 44 rotate.

The valve housing 94 includes a top housing segment 96 and a bottom housing segment 98. In another embodiment, the valve housing 70 can be made of a single segment or the valve housing 94 can be made of more than two segments.

Referring again to FIG. 5, the valve housing 94 includes an inner housing wall 100*a* and an optional outer housing wall 100*b*. The inner housing wall 100*a* has an inner housing surface 102. In the illustrated embodiment, the inner housing surface 102 is coated with a chromium alloy to provide a low friction and extended wear surface. Alternatively, the inner housing surface 102 may not be coated with a low friction and extended wear surface or the inner housing surface 102 may be coated with other materials, such as a nickel alloy, sufficient to provide a low friction, extended wear surface.

Referring again to FIG. 5, the valve housing 94 is curved and extends to form an approximate semi-circular cross-sectional shape. The semi-circular cross-sectional shape of the valve housing 94 has an approximate inside diameter that approximates the diameter of an arc 104 formed by the vane tips 74 of the rotating sealing vane assemblies 44. In operation, the vane tips 74 of the sealing vane assemblies 44 seal against the inner housing surface 102 such that finely shredded blowing insulation material entering the discharge mechanism 28 is contained within a wedge-shaped space 106 defined by adjacent sealing vane assemblies 44 and the inner housing surface 102. The wedge-shaped space 106 will be discussed in more detail below.

Referring again to FIG. 5, the valve housing 94 includes an eccentric segment 108. The eccentric segment 108 extends from or bulges out from the semi-circular shape of the top housing segment 96 and the bottom housing segment 98. In the illustrated embodiment, the eccentric segment 108 has an approximate cross-sectional shape of a dome. Alternatively, the eccentric segment 108 can have any cross-section shape that extends from the top housing segment 96 and the bottom housing segment 98. The eccentric segment 108 includes an inner eccentric surface 109. The eccentric segment 108 forms an eccentric region 112 which is defined as the area bounded by the inner eccentric surface 109 and the arc 104 formed by the vane tips 74 of the rotating sealing vane assemblies 44. The eccentric region 112 is within the airstream flowing through the discharge mechanism 28. In operation, as a sealing vane assembly 44 rotates into the airstream 33, the vane tip 74 of the sealing vane assembly 44 becomes spaced apart from the inner housing surface 102 of the valve housing 94. As the sealing vane assembly 44 further rotates within the eccentric region 112, the airstream 33 flows along the vane tip 74, thereby forcing any particles of blowing wool caught on the vane tip 74 to be blown off. This clearing of the sealing vane assembly 44 prevents a buildup of shredded blowing insulation material from forming on the sealing vane assembly 44.

Referring again to FIG. 5, the wedge-shaped space 106 is defined by adjacent sealing vane assemblies 44 and the inner housing surface 102. In the illustrated embodiment, a quantity of six sealing vane assemblies 44 are circumferentially spaced apart around the valve shaft 40. An angle $\alpha$ is formed between adjacent sealing vane assemblies 44. With a quantity of six sealing vane assemblies 44, the angle $\alpha$ is about 60°. However, it should be appreciated that in other embodiments having more or less than six sealing vane assemblies, the angle $\alpha$ can be more or less than about 60°.

Figure 6:
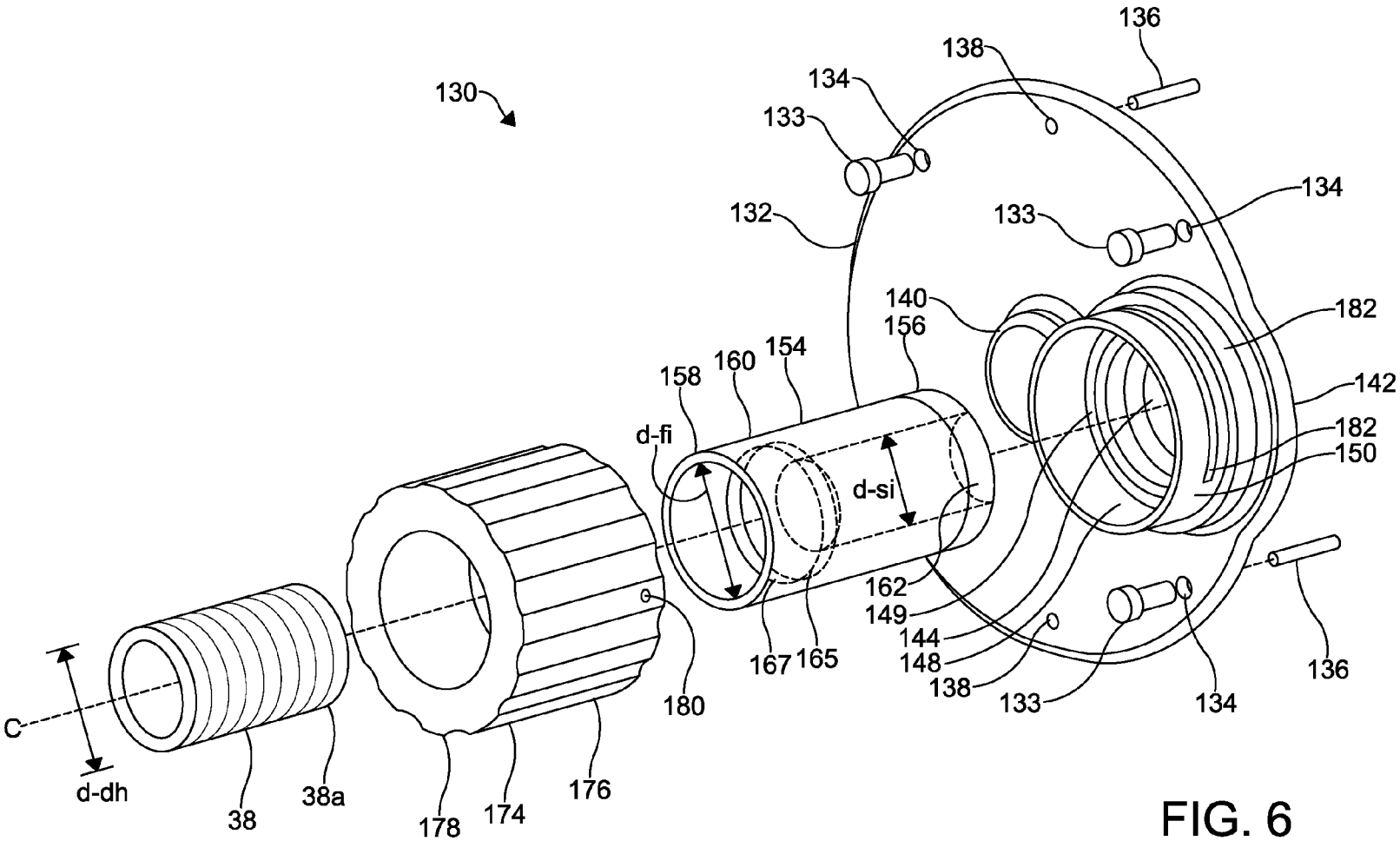
FIG. 6 is a perspective exploded view of an outlet plate assembly of the loosefill insulation blowing machine of FIG. 1.

Referring now to FIG. 6, the discharge mechanism 28 further includes an outlet plate assembly 130. The outlet plate assembly 130 is positioned at the machine outlet 32 and is configured to substantially cover the outlet end of the discharge mechanism 28. The outlet plate assembly 130 is further configured to connect the distribution hose 38 to the discharge mechanism 28.

Referring again to FIG. 6, the outlet plate assembly 130 includes an outlet plate 132 configured to substantially cover the outlet end of the discharge mechanism 28. In the illustrated embodiment, the outlet plate 132 is made from aluminum, although the outlet plate 132 can be made from other materials, including brass or plastic, sufficient to substantially cover the outlet end of the discharge mechanism 28.

The outlet plate 132 is attached to the discharge mechanism 28 by a plurality of outlet plate fasteners 133. In the illustrated embodiment, the outlet plate fasteners 133 are threaded bolts extending through a plurality of outlet plate mounting apertures 134 disposed in the outlet plate 132. In the illustrated embodiment, the outlet plate fasteners 133 have a diameter of approximately 0.25 inches. In another embodiment, the outlet plate fasteners 133 can have a diameter that is larger or smaller than 0.25 inches, sufficient to attach the outlet plate 132 to the discharge mechanism 28. While the illustrated embodiment shows a quantity of three outlet plate fasteners 133, it should be understood that any number of outlet plate fasteners 133, sufficient to attach the outlet plate 132 to the discharge mechanism 28, can be used. In other embodiments, the outlet plate 132 can be attached to the discharge mechanism 28 by other means including the non-limiting examples of mechanical fasteners, such as clips or clamps.

The outlet plate 132 includes one or more positioning pins 136. The positioning pins 136 are configured to position the outlet plate 132 in a proper location on the discharge mechanism 28. The positioning pins 136 are disposed in mounting apertures 138. The positioning pins 136 are configured to align the outlet plate 132 to the discharge mechanism 28 by insertion of the positioning pins 136 into corresponding mounting holes (not shown) in the discharge mechanism 28. While the illustrated embodiment shows a quantity of two positioning pins 136, it should be understood that any number of positioning pins 136, sufficient to align the outlet plate 132 to the discharge mechanism 28, can be used. The positioning pins 136 can have any desired size, shape and configuration sufficient to align the outlet plate 132 to the discharge mechanism 28.

Referring again to FIG. 6, the outlet plate 132 includes a bearing pocket 140 configured to contain a bearing (not shown). The bearing and the bearing pocket 140 support one end of the rotating valve shaft 40. In the illustrated embodiment, the bearing is a self-contained ball bearing. In other embodiments, the bearing can have other forms, such as for example, roller bearings or sleeve bearings, sufficient to support one end of the rotating valve shaft 40. In the embodiment shown in FIG. 6, the bearing pocket 140 is positioned approximately in the center of the outlet plate 132. However, in other embodiments, the bearing pocket 140 can be positioned elsewhere in the outlet plate 132.

Referring again to FIG. 6, the outlet plate 102 includes an outlet plate eccentric region, indicated generally at 142, configured to cover the eccentric segment 108 of the discharge mechanism 28.

As shown in FIG. 6, the outlet plate 132 includes an internal passage 144. The internal passage 144 is configured to direct the airstream 33 exiting the discharge mechanism 28. In the illustrated embodiment, the internal passage 144 is sized and shaped to include the eccentric region 112 of the discharge mechanism 28. In another embodiment, the internal passage 144 can be any desired size and shape sufficient to direct the airstream 33 exiting the discharge mechanism 28.

Referring again to FIG. 6, the outlet plate 132 includes a support 146. As will be discussed in more detail below, the support 146 includes a plurality of internal segments configured to form the internal passage 144. The support 146 is positioned on the outlet plate 132 such that discharged finely conditioned insulation material exits the discharge mechanism 28 through the internal passage 144 and through the support 146. In the illustrated embodiment, the support 146 is made of aluminum. In other embodiments, the support 146 can be other materials, such as plastic or brass. In the illustrated embodiment, the support 146 is attached to the outlet plate 132 by sonic welding. Alternatively, the support 146 can be attached to the outlet plate 132 by other mechanisms, such as for example clips, clamps or adhesive. In still other embodiments, the support 146 can be formed integral to the outlet plate 132.

Referring again to FIG. 6, the outlet plate assembly 130 includes an outlet pipe 154. The outlet pipe 154 is hollow and is configured to connect the distribution hose 38 to the outlet plate assembly 130. The outlet pipe 154 has a plate end 156, a hose end 158 and an outer surface 160. The outlet pipe 154 has a member 162 arranged circumferentially about the outer surface 160 at the plate end 156. The member 162 is configured to seat against an inner shoulder 149 of the support 146 when the outlet pipe 154 is inserted into the support 146. In the illustrated embodiment, the member 162 is created from a snap ring. In other embodiments, the member 162 can be created from other structures, such as for example a clip, rib or clamp, sufficient to seat against the inner shoulder 149 of the support 146.

Referring again to FIG. 6, the hose end 158 of the outlet pipe 154 has a first inner diameter d-fi and the plate end 156 of the outlet pipe 154 has a second inner diameter d-si. The first inner diameter d-fi of the hose end 158 of the outlet pipe 154 is configured to support the distribution hose 38 having a corresponding outer diameter d-dh. In the illustrated embodiment, the first inner diameter d-fi of the outlet pipe 154 is approximately 1.625 inches and is configured to support a distribution hose 38 having an outer diameter d-dh of approximately 1.625 inches. The use of the distribution hose 38 having an outer diameter d-dh of approximately 1.625 inches advantageously balances the need to provide a high throughput of conditioned loosefill insulation material through the distribution hose 38 while facilitating the wrapping of long lengths of the distribution hose 38 around the hub 82 within the chute 14. In other embodiments, the first inner diameter d-fi of the outlet pipe 154 can be other sizes sufficient to support a mating distribution hose 38. In operation, a first end 38*a* of the distribution hose 38 is inserted into the hose end 158 of the outlet pipe 154 until the first end 38*a* seats against a shoulder 165 created by the second inner diameter d-si. The first end 38*a* of the distribution hose 38 is retained within the outlet pipe 154 by a retaining mechanism 167. In the illustrated embodiment, the retaining mechanism 167 is a clamp. Alternatively, the retaining mechanism 167 can be other mechanisms, structures or devices, such as for example clips, sufficient to retain the first end 38*a* of the distribution hose 38 within the outlet pipe 154.

Referring again to FIG. 6, seating of the first end 38*a* of the distribution hose 38 against the shoulder 165 of the outlet pipe 154 creates a smooth transition to facilitate the flow of finely conditioned insulation material discharged by the discharge mechanism 28 and flowing into the distribution hose 38. The term "smooth transition" as used herein, is defined to mean facilitating the uninterrupted flow of finely conditioned insulation material and providing a sealing function between the distribution hose 38 and the outlet plate 132. In the illustrated embodiment, seating of the first end 38*a* of the distribution hose 38 against the shoulder 165 seals that portion of the path of the finely conditioned insulation material. In another embodiment, the first end 38*a* of the distribution hose 38 can be sealed against the shoulder 165 using other mechanisms, such as for example sealing gaskets.

The outlet plate assembly 130 includes a retention member 174. The retention member 174 includes a second fastening portion (not shown), a grip surface 176 and an end section 178. In general, the retention member 174 is configured to fasten the outlet pipe 154 to the support 146. The second fastening portion of the retention member 174 has at least one fastening pin 180. The fastening pin 180 is configured to engage a first fastening portion 182 located on the support 146. In the illustrated embodiment, the fastening pin 180 is a steel pin extending inward toward the center of the retention member 174 and having a flat bottom (not shown). In other embodiments, the fastening pin 180 can be another structure or mechanism sufficient to engage the first fastening portion 182.

Referring again to the embodiment illustrated in FIG. 6, the first fastening portion 182 is a double start thread having a square thread bottom. In other embodiments, the first fastening portion 182 can have other configurations. In operation, as the retention member 174 is rotated about axis C--, the fastening pin 180 engages and follows the double start thread of the first fastening portion 182. As the fastening pin 180 follows the thread, the retention member 174 is moved in an axial direction toward the outlet plate 132. The retention member 174 continues to move toward the outlet plate 132 until the end section 178 of the retention member 174 seats against the substantially flat surface at the hose end 158 of the outlet pipe 154. In this position, the retention member 174 fastens the outlet pipe 154 to the support 146. In another embodiment, the retention member 174 can fasten the outlet pipe 154 to the support 146 with other mechanisms, structure or devices, such as for example clips or clamps. While the embodiment shown in FIG. 6 illustrates a quantity of one fastening pin 180, it should be understood that any number of fastening pins can be used.

Referring again to FIG. 6, the retention member 174 includes grip surface 176. The grip surface 176 is configured to allow the machine 10 user to grip and rotate the retention member 174 by hand and without the use of special tools. While the grip surface 176 of the retention member 174 is shown as having a plurality of grooves, it should be understood that the grip surface 176 can have any configuration sufficient to allow the machine user to grip and rotate the retention member 174 by hand and without the use of special tools. In the illustrated embodiment, the retention member 174 is made of aluminum. Alternatively, the retention member 174 can be made of suitable other materials, such as for example brass or plastic.

Figure 7:
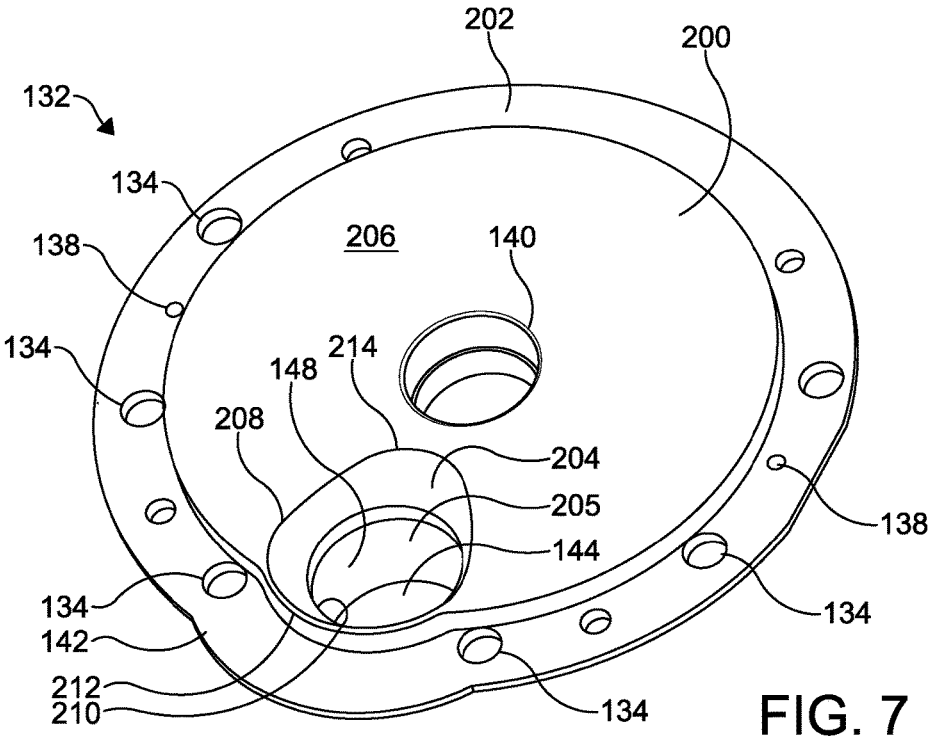
FIG. 7 is a perspective view of an outlet plate of the outlet plate assembly of FIG. 6.
Figure 8:
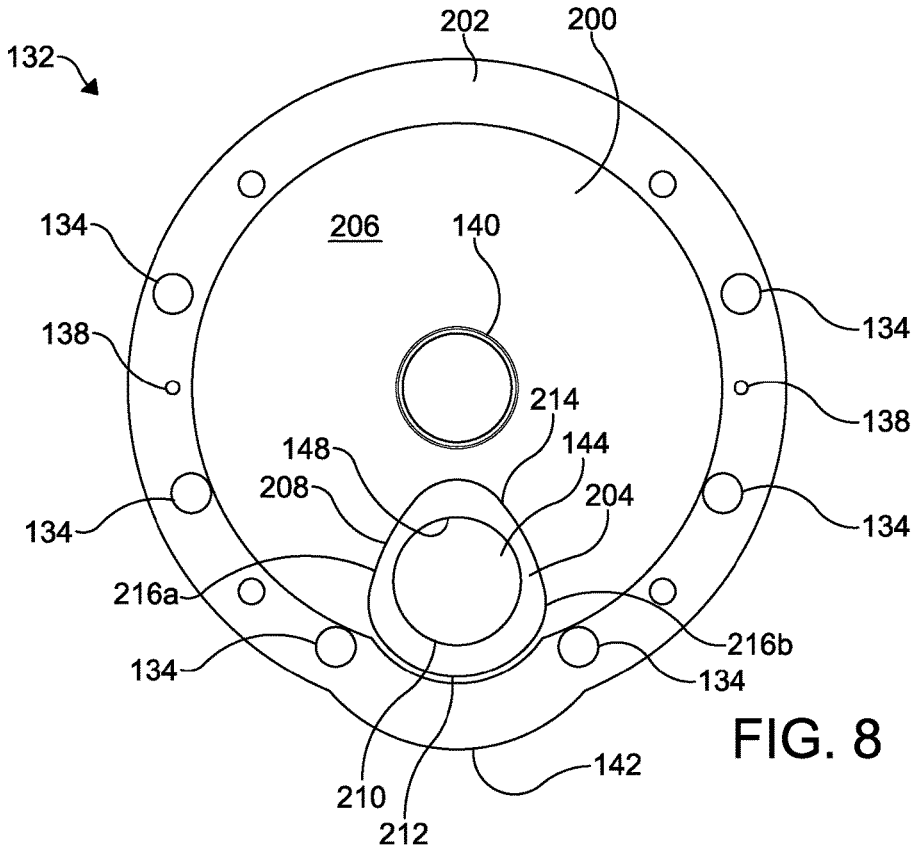
FIG. 8 is a plan view of the outlet plate of FIG. 7.
Figure 9:
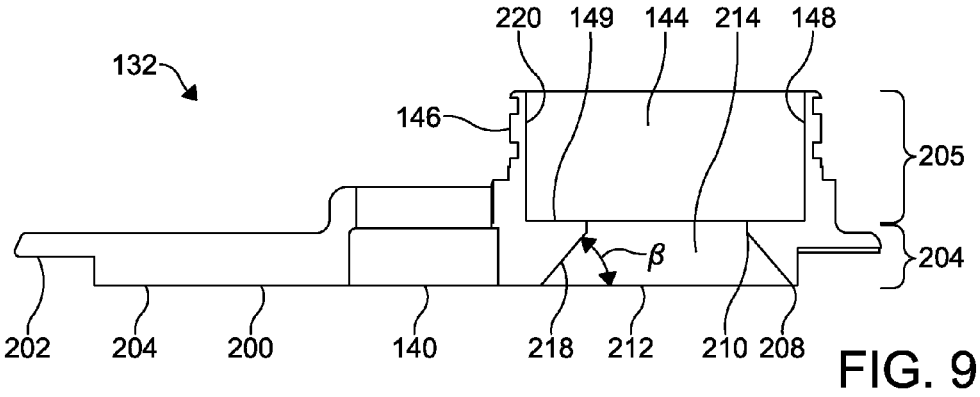
FIG. 9 is a side view, in elevation, of the outlet plate of FIG. 7.

Referring now to FIGS. 7-9, the outlet plate 132 is illustrated. The outlet plate 132 includes an inner portion 200 extending to an outer rim 202. The inner portion 200 includes the bearing pocket 140 as discussed above and shown in FIG. 7. The outer rim 202 includes outlet plate mounting apertures 134, mounting aperture 138 and the outlet plate eccentric region 142 as discussed above and shown in FIG. 6.

Referring again to FIGS. 7-9, the inner portion 200 of the outlet plate 132 includes the internal passage 144. The internal passage 144 is defined by a first segment 204 and a second segment 205. The first segment 204 extends from a surface 206 of the inner portion 200 of the outlet plate 132 to the second segment 205. The second segment 205 extends from the first segment 204 to an external end of the support 146.

Referring again to FIGS. 7-9, the first segment 204 is defined by an inner perimeter 208 and an outer perimeter 210. The inner perimeter 208 includes a first end 212 connected to an opposing second end 214 by opposing sides 216*a*, 216*b*. The first end 212, second end 214 and opposing sides 216*a*, 216*b* cooperate to form the inner perimeter 208 such that the inner perimeter 208 has a non-circular cross-sectional shape, or the approximate cross-sectional shape of an egg.

Figure 10:
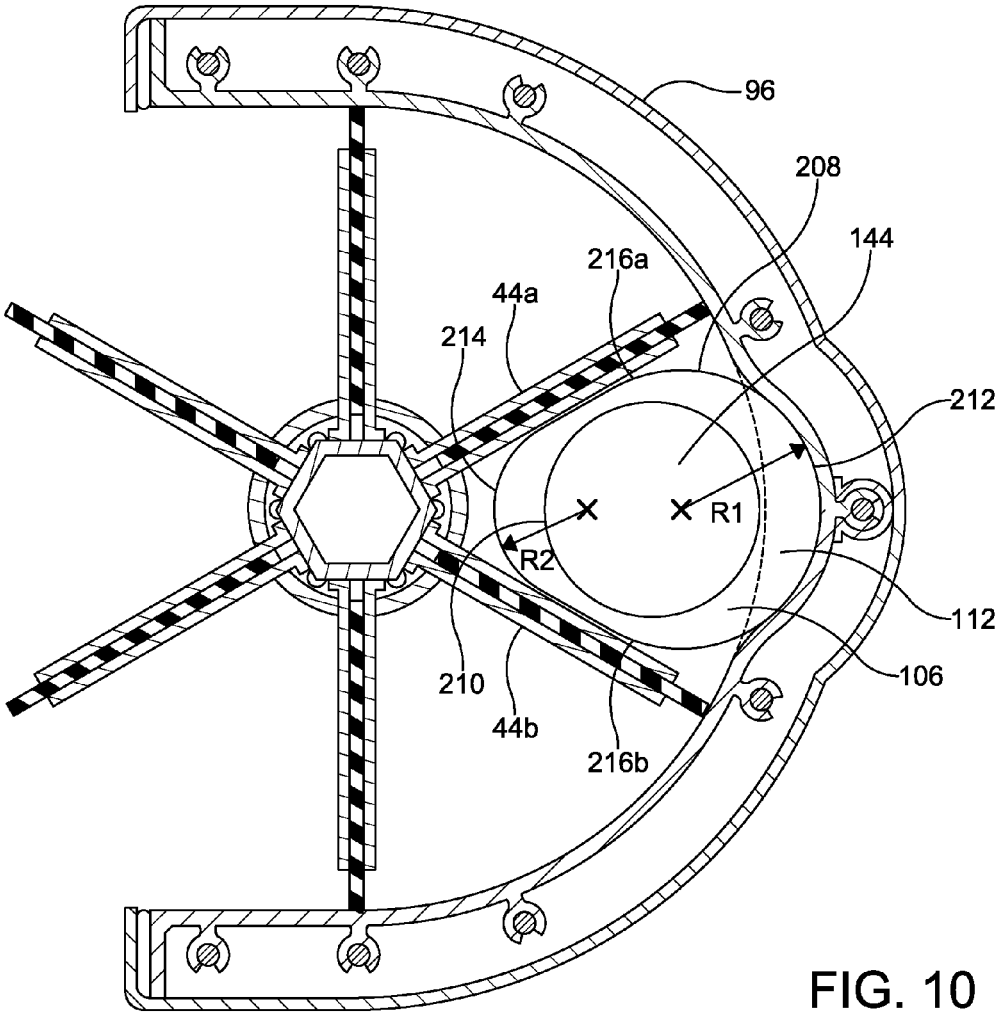
FIG. 10 is a front view, in elevation, in cross-section, of a portion of the discharge mechanism of FIG. 5.

Referring now to FIG. 10, the internal passage 144, inner perimeter 208 and outer perimeter 210 are illustrated with the valve housing 94 and the wedge-shape space 106 formed by adjacent sealing vane assemblies 44*a*, 44*b*. The first end 212 of the inner perimeter 208 has an arcuate shape that approximates the arcuate shape of the outlet plate eccentric region 142 and abuts the outlet plate eccentric region 142. In this manner, the arcuate shape of the first end 212 of the inner perimeter facilitate the flow of finely conditioned loosefill insulation material through the eccentric region 112 of the discharge mechanism 28 and further effectively prevents buildup of finely conditioned loosefill insulation material from forming within eccentric region 112.

Referring again to FIG. 10, with the adjacent sealing vane assemblies 44*a*, 44*b* in the illustrated position, the sides 216*a*, 216*b* of the inner perimeter 208 abut longitudinal portions of the sealing vane assemblies 44*a*, 44*b*. In this manner, the sides 216*a*, 216*b* of the inner perimeter 208 facilitate the flow of finely conditioned loosefill insulation material through the discharge mechanism 28 and further effectively prevent buildup of finely conditioned loosefill insulation material from forming within the internal passage 144.

Referring again to FIG. 10, the inner perimeter 208 has the cross-sectional shape of an egg, with a first end 212 adjacent the outlet plate eccentric region 142 and the second end adjacent the shaft lock 46. The first end 212 has a first radius R1 and the second end 214 has a second radius R2. In the illustrated embodiment, the first radius R1 is in a range of from about 1.0 inches to about 1.5 inches and the second radius R2 is in a range of from about 0.5 inches to about 0.75 inches. Since the first radius R1 of the first end 212 is greater than the second radius R2 of the second end 214, the resulting cross-sectional shape of the inner perimeter 208 is configured to closely approximate the cross-sectional shape of wedge shaped space 106. The term "closely approximates", as used herein, is defined to mean the inner perimeter 208 occupies between 80.0% and 90.0% of the wedge shaped space 106. Without being held to the theory, it is believed an inner perimeter 208 having this size and shape facilitates the flow of finely conditioned loosefill insulation material through the discharge mechanism 28 and further effectively prevents buildup of finely conditioned loosefill insulation material from forming within the internal passage 144.

Referring now to FIG. 9, the first segment 204, defined at the surface 206 of the inner portion 200 by the inner perimeter 212, extending to the second segment 206, defined by the outer perimeter 214, is illustrated. Since the inner perimeter 212 has a length that is longer than the outer perimeter 214, a transitional wall 218 extending from the inner perimeter 212 to the outer perimeter 214 is tapered. The tapered transitional wall 218 is configured to connect the non-circular or egg-shaped inner perimeter 212 with the circular outer perimeter 214, thereby facilitating the flow of discharged finely conditioned insulation material exiting the discharge mechanism 28 to the distribution hose 38. The transitional wall 218 forms a circumferential angle β with the surface 206 of the inner portion 200 of the outlet plate 132. In the illustrated embodiment, the angle β is in a range of from about 30° to about 60°. Alternatively, the angle β can be less than about 30° or more than about 60° sufficient to connect the non-circular or egg-shaped inner perimeter 212 with the circular outer perimeter 214 and facilitate the flow of discharged finely conditioned insulation material exiting the discharge mechanism 28 to the distribution hose 38.

Referring again to FIG. 9, the transitional wall 218 of the support 146 has a smooth finish configured to facilitate the flow of discharged finely conditioned insulation material. In other embodiments, the transitional wall 218 can have other finishes, such as for example, a coating of anti-friction material, sufficient to facilitate the flow of finely conditioned insulation material.

Referring again to FIG. 9, the segment 205 includes an inner circumferential wall 220 and the inner shoulder 149. The inner circumferential wall 220 has a circular cross-sectional shape configured to receive the plate end 156 of the outlet pipe 154.

It should be appreciated that the tapered transitional wall 218 of the outlet plate 132 advantageously balances the ability to provide a high throughput of conditioned loosefill insulation material through the distribution hose 38 with the ability to substantially prevent unwanted accumulations of conditioned loosefill insulation material in the discharge mechanism 28 and the distribution hose 38.

The principle and mode of operation of the loosefill insulation blowing machine hose outlet plate assembly have been described in certain embodiments. However, it should be noted that the loosefill insulation blowing machine hose outlet plate assembly may be practiced otherwise than as specifically illustrated and described without departing from its scope.

What is claimed is:

1. A system for distributing blowing insulation material from a package of compressed loosefill insulation material, the machine comprising:

a chute having an inlet portion and outlet portion, the inlet portion configured to receive the package of compressed loosefill insulation material; and a lower unit configured to receive the compressed loosefill insulation material exiting the outlet portion of the chute, the lower unit including a plurality of shredders and a discharge mechanism, the discharge mechanism configured to discharge conditioned loosefill insulation material into an airstream, the discharge mechanism including a hose outlet plate assembly configured to cover an outlet end of the discharge mechanism and further configured to connect a distribution hose to the discharge mechanism, the hose outlet plate assembly including an inner passage defined by a tapered transitional wall of a first segment and an inner wall of a second segment, the tapered transitional wall of the first segment having an inner perimeter and an outer perimeter, the outer perimeter having a diameter that is less than an inner diameter of the second segment.

2. The system of claim 1, wherein the tapered passage is defined by a transitional wall forming an angle in a range of from 30° to 60°.

3. The system of claim 2, wherein the angle is formed between the transitional wall and a surface of an inner portion of an outlet plate.

4. The system of claim 1, wherein the tapered passage connects with a portion of a support having a circular cross-sectional shape.

5. The system of claim 1, wherein the tapered passage narrows in a downstream direction.

6. The system of claim 1, wherein the tapered passage is defined at one end by a transitional wall having a non-circular perimeter.

7. The system of claim 6, wherein the non-circular perimeter has the cross-sectional shape of an egg.

8. The system of claim 7, wherein the non-circular perimeter has an arcuate first end configured to abut an eccentric segment of a discharge mechanism housing.

9. The system of claim 8, wherein the non-circular perimeter has an arcuate second end that has a smaller radius than a radius of the arcuate first end.

10. The system of claim 1, wherein the tapered passage is defined by a transitional wall, the transitional wall having an inner perimeter with a length that is longer than a length of an outer perimeter.

11. The system of claim 10, wherein the inner perimeter has the cross-sectional shape of an egg.

12. The system of claim 11, wherein the outer perimeter has a circular cross-sectional shape.

13. The system of claim 12, wherein the transitional wall forms a taper from the inner perimeter to the outer perimeter.

14. The system of claim 10, wherein the inner perimeter has an arcuate first end configured to abut an eccentric segment of a discharge mechanism housing.

15. The system of claim 14, wherein the inner perimeter is configured to cover an eccentric region formed by the discharge mechanism housing.

16. The system of claim 1, wherein the tapered passage is defined at one end by a transitional wall having a perimeter, wherein the perimeter occupies a wedge-shaped space between adjacent sealing vane assemblies.

17. The system of claim 16, wherein the perimeter has an arcuate first end configured to abut an eccentric segment of a discharge mechanism housing.

18. The system of claim 17, wherein the perimeter has an arcuate second end configured to abut a valve shaft.

19. The system of claim 18, wherein the perimeter has opposing sides connecting the first and second ends, and wherein the opposing sides are configured to abut portions of adjacent sealing vane assemblies.

20. The system of claim 16, wherein the wedge-shaped space between adjacent sealing vane assemblies includes an eccentric region.

* * * * *